US006925728B2

(12) United States Patent
Busa et al.

(10) Patent No.: US 6,925,728 B2
(45) Date of Patent: Aug. 9, 2005

(54) GROOMING DEVICE WITH VACUUM FOR DRYING AND STRAIGHTENING HAIR

(75) Inventors: Kathleen M. Busa, 8 The High Rd., Bronxville, NY (US) 10708; Car line Busa, Bronxville, NY (US); Mark Andre Colbért, Waterbury, CT (US)

(73) Assignee: Kathleen M. Busa, Southampton, NY (US)

( * ) Notice: Subject to any disclaimer, the term of this patent is extended or adjusted under 35 U.S.C. 154(b) by 0 days.

(21) Appl. No.: 10/384,842

(22) Filed: Mar. 10, 2003

(65) Prior Publication Data

US 2003/0172543 A1 Sep. 18, 2003

Related U.S. Application Data

(63) Continuation-in-part of application No. 10/096,053, filed on Mar. 12, 2002, now abandoned.

(51) Int. Cl.[7] ..... A45D 20/00
(52) U.S. Cl. ..... 34/96; 34/97; 34/92
(58) Field of Search ..... 34/283, 92, 96–101; 132/271–272; 392/380–385; D28/13, 18; 219/222

(56) References Cited

U.S. PATENT DOCUMENTS

| | | | | | |
|---|---|---|---|---|---|
| 1,431,943 | A | | 10/1922 | Gee | |
| 1,853,226 | A | | 4/1932 | Rapids | |
| 1,859,714 | A | | 5/1932 | Rapids | |
| 2,503,113 | A | | 4/1950 | Hribar | |
| 2,817,000 | A | * | 12/1957 | Scheid | 392/383 |
| 2,866,221 | A | | 12/1958 | Warva | |
| 3,972,126 | A | | 8/1976 | DeMuro et al. | |
| 4,210,162 | A | * | 7/1980 | Dreyer et al. | 132/271 |
| 4,254,324 | A | * | 3/1981 | Vrtaric | 392/385 |
| 4,409,998 | A | | 10/1983 | Bauer | |
| 4,419,835 | A | | 12/1983 | Strain | |
| 4,593,179 | A | * | 6/1986 | Schulz et al. | 392/365 |
| 4,602,542 | A | | 7/1986 | Natrasevschi | |
| 4,628,601 | A | * | 12/1986 | Van Slooten | 30/133 |
| 4,679,322 | A | * | 7/1987 | Hunts | 30/133 |
| 4,683,369 | A | * | 7/1987 | Rieckman et al. | 392/385 |
| 4,706,326 | A | | 11/1987 | Romani | |
| 4,977,690 | A | | 12/1990 | Davis, Jr. | |
| 5,031,320 | A | * | 7/1991 | Persyn | 30/133 |
| 5,142,786 | A | * | 9/1992 | Hunts | 30/133 |
| 5,168,641 | A | * | 12/1992 | Smal | 34/97 |
| 5,231,762 | A | * | 8/1993 | Hunts | 30/133 |
| 5,269,073 | A | * | 12/1993 | Johnson | 34/60 |
| 5,435,327 | A | | 7/1995 | Ho | |
| 5,444,215 | A | | 8/1995 | Bauer | |
| 5,924,215 | A | | 7/1999 | Goodsell | |
| 6,205,674 | B1 | * | 3/2001 | Kaizuka | 34/96 |
| 6,434,855 | B1 | | 8/2002 | Miller | |
| 2002/0184785 | A1 | | 12/2002 | Miller | |

* cited by examiner

*Primary Examiner*—Henry Bennett
*Assistant Examiner*—Andrea M. Ragonese
(74) *Attorney, Agent, or Firm*—Cowan, Liebowitz & Latman, P.C.

(57) ABSTRACT

A grooming device having a first unit and upper hand-held unit connected to the first unit is disclosed. A vacuum unit in the first unit creates a vacuum air flow in a vacuum chamber in the hand-held unit, while a heating unit in the first unit generates a heated air flow to a heat chamber in the hand-held unit. The heat chamber and vacuum chamber are contained within a vessel in the hand-held unit. The heat chamber is separated from the vacuum chamber by a wall having regularly spaced pores. When both the vacuum unit and heating unit of the device are switched on, the vacuum flow in the vacuum chamber pulls heated air from the heat chamber through pores in the wall so that dry, heated air flows along the length of the vessel. Thus, hair placed in the vacuum chamber of the hand-held unit is exposed to the combined effect of the vacuum and flow of heated air. In a further embodiment, the wall of the vacuum chamber is heated by a heating element thereby causing the vacuum flow to be heated.

42 Claims, 10 Drawing Sheets

GROOMING DEVICE WITH VACUUM FOR DRYING AND STRAIGHTENING HAIR

CROSS REFERENCE TO RELATED APPLICATIONS

This application is a continuation-in-part of U.S. patent application Ser. No. 10/096,053, filed Mar. 12, 2002, now abandoned.

BACKGROUND OF THE INVENTION

1. Field of the Invention

This invention relates to a grooming device for use in drying and straightening or adding volume to hair, and more particularly to an apparatus with integrated power supply, vacuum unit and drying unit for drying and styling of hair either in a salon or at home.

2. Description of the Related Art

Hair dryers are well known in the prior art. In particular, grooming devices that combine the structural features of a hair dryer with the familiar function of a vacuum to fulfill objectives relating to collection of debris and hair clippings are known and include, for example, U.S. Pat. No. 5,924,215 to Goodsell; U.S. Pat. No. 5,435,327 to Ho; U.S. Pat. No. 4,706,326 to Romani; and U.S. Pat. No. 3,972,126 to DeMuro et al.

Each of the above patents recognizes the utility of a vacuum device in conjunction with a hair-drying device for achieving various objectives, primarily the removal of debris and hair clippings, or the reduction of air pressure in a hair drying apparatus. However, while the prior art references generally achieve a cleaner grooming environment, each accomplishes drying of hair with only the air heating and blowing functionality of the device, which takes approximately the same amount of time as other conventional means for drying hair.

In addition, straight hairstyles of recent and growing popularity require additional styling time, especially in the case of naturally curly or wavy hair. Hairstylists can easily spend an additional 20–60 minutes after cutting and substantially drying hair to "blow-out" hair, or apply heated air in the direction of the hair strands while holding hair taut with a brush, in order to sufficiently straighten and add volume to hair for many of today's popular hairstyles. In addition to longer styling time, such methods for straightening hair can easily overdry or damage hair. No less damaging, faster, or easier method for drying and straightening hair is known or in use today.

Thus, there has been a need in the art for a device that is capable of both drying and styling hair in less time, and particularly for achieving straight hair more quickly and efficiently without damaging the hair. The grooming device of the present invention substantially departs from devices in the prior art by providing an apparatus for drying and straightening hair in significantly less time and with substantially less effort than by using conventional means, without damaging the hair.

SUMMARY OF THE INVENTION

The present invention is drawn to a unique grooming device that overcomes the above-described and other drawbacks of the prior art and provides an apparatus for drying and straightening hair with one device in significantly less time than required by conventional drying and styling devices and methods. Specifically, an apparatus is herein described that includes a vacuum and air heater and a hand-held unit attached to the apparatus by a hose, such that the vacuum and heater are applied directly to hair and are capable of simultaneous operation for efficiently drying and straightening hair. In the apparatus of the present invention, the direct application of a vacuum air flow to hair removes moisture from the hair and holds hair taut while dry heated air is simultaneously applied to the hair.

It is therefore an object of the invention to overcome the limitations of the prior art described above by providing an apparatus for efficiently drying and straightening hair in approximately half the time required by conventional drying means without damaging the hair.

It is a further object of the invention to provide an apparatus that is adaptable for professional use in a salon and can be modified for home or portable use.

It is yet a further object of the invention to provide a hair dryer that combines the drying and styling capabilities of a conventional hair dryer with a vacuum air flow to maximize the drying efficiency and styling capabilities of the dryer.

In accordance with the principles of the present invention, the above and other objects are realized in a grooming device having a lower unit containing a vacuum unit connected to a vacuum tube and a heating unit connected to a heating tube, and an upper hand-held unit connected to the lower unit by a hose, the hose containing the vacuum and heating tubes, in which the upper hand-held unit comprises a base and a vessel, the vessel having an inner vacuum chamber and an outer heat chamber separated from the inner vacuum chamber by a wall, and the base enclosing the sealed junction of the vacuum tube with the vacuum chamber and of the heating tube with the heat chamber, wherein pores are disposed in the wall between the vacuum and heat chambers in the vessel, and wherein heated air is supplied by the heating unit to the outer heat chamber of the vessel and vacuum pressure generated by the vacuum unit is exerted on the inner vacuum chamber of the vessel, such that the heated air flow and vacuum air flow are combined in the inner vacuum chamber and hair placed within the inner vacuum chamber is simultaneously dried by both vacuum pressure and heated air flow.

It will be obvious to those skilled in the art that the device described herein may provide a model or basis for the design of other devices and systems for carrying out the objects of the present invention and can be constructed in different embodiments and practiced in various ways.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

The grooming device of the present invention includes a lower unit and an upper hand-held unit connected to the lower unit by a hose. A vacuum unit in the lower unit creates a vacuum air flow in a vacuum chamber in the hand-held unit, while a heating unit in the lower unit generates a heated air flow to a heat chamber in the hand-held unit. The heat chamber and vacuum chamber are contained within a vessel in the hand-held unit. The heat chamber is separated from the vacuum chamber in the vessel by a wall having regularly spaced pores. When both the vacuum unit and heating unit of the device are switched on, the vacuum flow in the vacuum chamber pulls heated air from the heat chamber through pores in the wall and dry, heated air flows along the length of the hand-held unit such that hair placed in the vacuum chamber of the hand-held device is exposed to the combined effect of the vacuum and flow of heated air.

Figure 1:
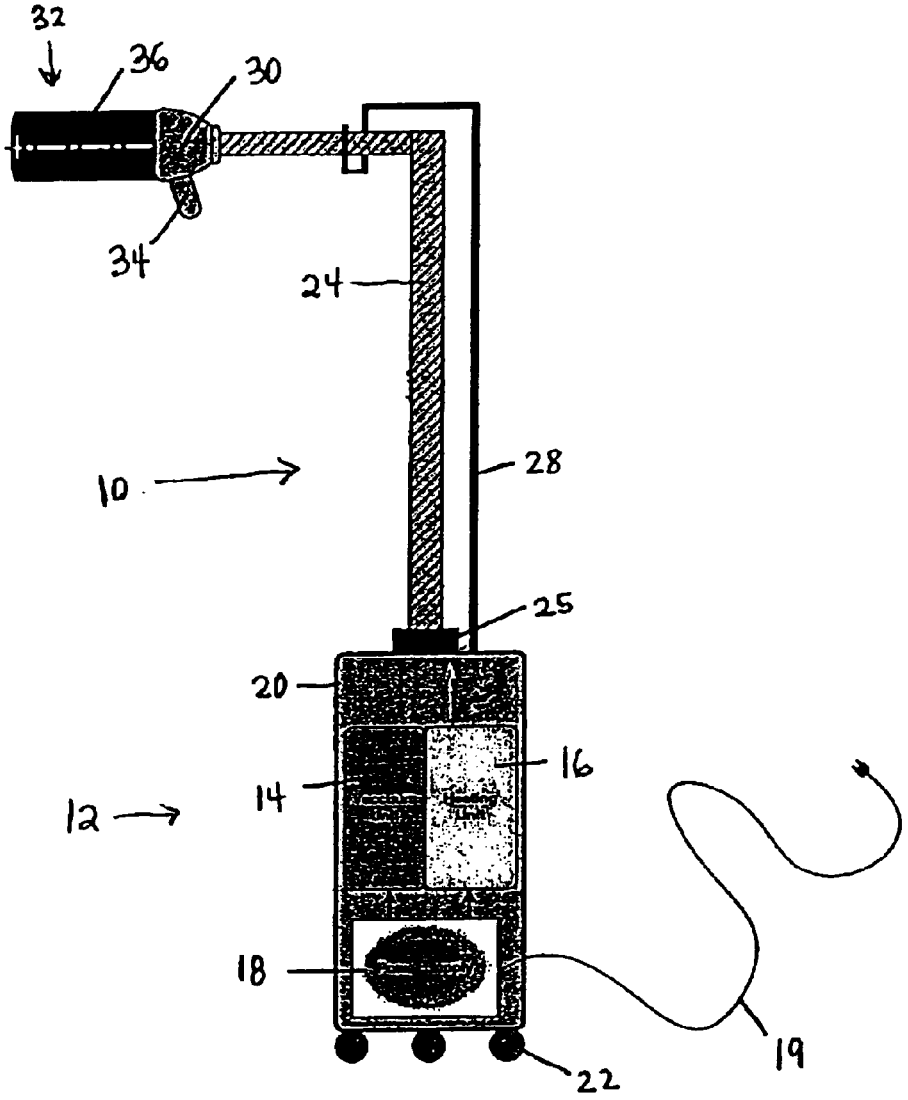
FIG. 1 is an elevational view of the invention showing the lower unit, hose and upper hand-held unit.

As shown in FIG. 1, the grooming device 10 includes a lower unit 12 that houses both a vacuum unit 14 and heating unit 16. Vacuum and heating units 14, 16 are described in further detail with respect to FIGS. 4, 6 and 7 below. Lower unit 12 also includes a power switch 17 (not shown in FIG. 1), power supply 18 and cord 19 for connection to an AC current source. The vacuum unit 14, heating unit 16 and power supply 18 are contained in housing 20, which can be made of ABS plastic or other suitable durable and lightweight material. Housing 20 of the lower unit 12 may be mounted on casters 22, as shown, for mobility, or may alternatively be set on legs or affixed to a floor or wall, requiring minimal space and ideally suited for use in a salon. The dimensions and cosmetic design of the lower unit 12 shown in FIG. 1 can be modified to accommodate various aesthetic and size requirements without changing the overall functionality of the invention.

Hose 24 is attached to the top of the lower unit 12 within a rubber seal 25. The hose 24 is made of plastic or other flexible material and houses both vacuum tube 26, which is attached to the vacuum unit 14, and heated air tube 27, which is attached to heating unit 16. Depending on its length and the requirements of the user, hose 24 may be supported by a detachable telescopic rigid plastic or metal support rod 28 that extends upwardly from the lower unit 12 and hooks around hose 24 to support it at the desired height of hand-held unit 32.

Hand-held unit 32 is attached to the hose 24 at the end opposite the lower unit 12. Specifically, as shown in FIG. 1, one end of the hose 24 terminates at the base 30 of the hand-held unit. The base 30 supports a vessel 36, which houses an inner vacuum chamber 38 and outer heating chamber 40, as shown in further detail in FIGS. 3A and 3B. Handle 34 is formed in the base 30 of the hand-held unit and allows the user to comfortably control the hand-held unit without having to touch vessel 36, which may become hot during operation of the device. Base 30 and handle 34 are each made of plastic or other durable, lightweight and heat-resistant material.

Figure 2:
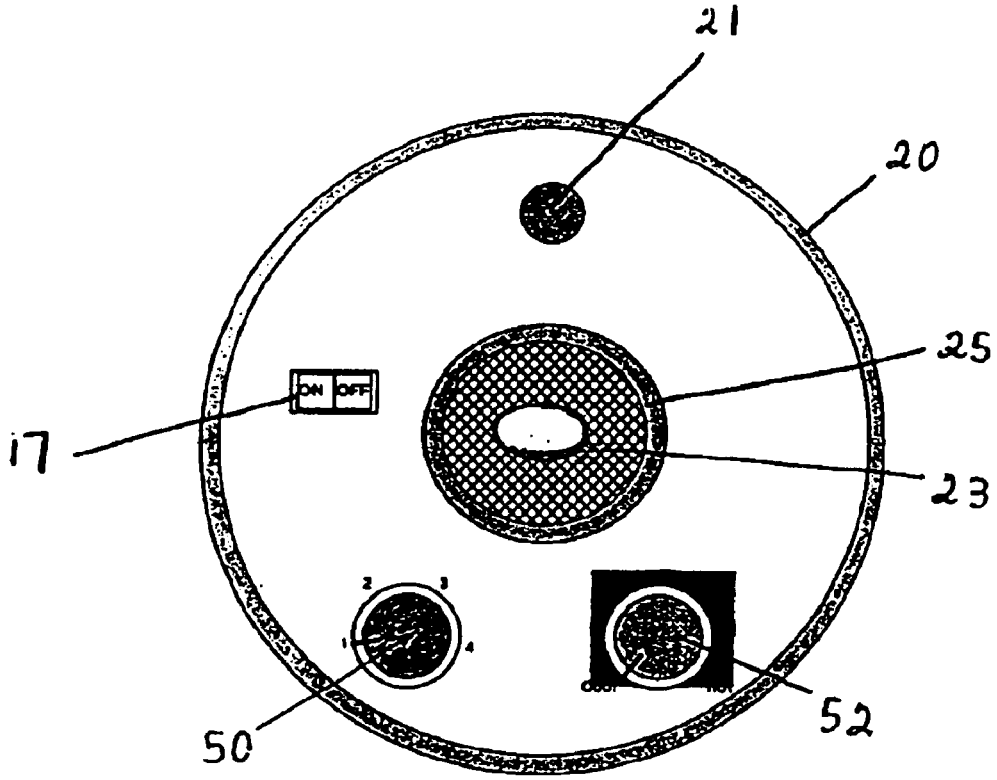
FIG. 2 is a top view of the lower unit of the apparatus of FIG. 1.

A port 23 for attachment of hose 24 to lower unit 12 is disposed on the top of lower unit 12, as shown in FIG. 2. Rubber seal 25 encircles hose attachment port 23 and provides a secure and airtight seal between hose 24 and lower unit 12. Hose 24 is attachable to port 23 by, for example, snapping or screwing an end of hose 24 to a corresponding snap or threaded end of port 23, or by any other suitable means of attachment. Port 23 further includes a receptacle through which vacuum and heating tubes 26 and 27, may be threaded from within hose 24 into lower unit 12 and attached to vacuum and heating units 14 and 16, respectively. In addition to main power switch 17, external speed control 50 and temperature control 52 in connection with vacuum and heating units 14, 16 may be disposed on top of lower unit 12. Such external speed and temperature controls are shown and described in detail below with respect to FIGS. 4, 6 and 7. An LED 21 or similar light indicator of the ON or OFF position of main power switch 17 may also be disposed on the top of lower unit 12.

Figures 3A, 3B:
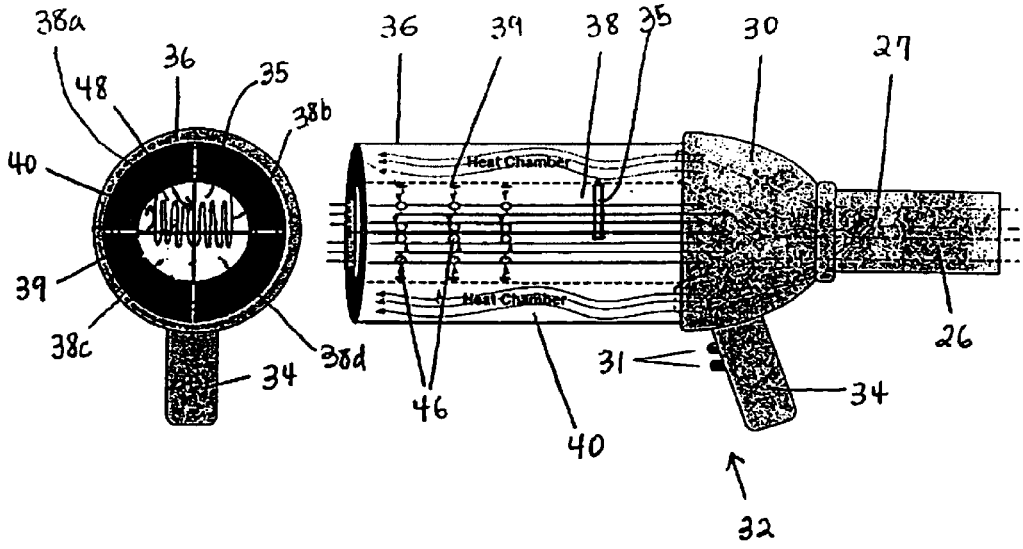
FIG. 3A is a detailed view of the hand-held unit showing the operation of the device in accordance with the invention as shown in FIG. 1.
FIG. 3B is a cross-sectional view of the hand-held unit of FIG. 3A.

A more detailed view of the hand-held unit of the apparatus is shown in FIG. 3A. The base 30 of the hand-held unit 32 houses the sealed junction of the ends of the vacuum and heating tubes 26, 27 with respective vacuum and heat chambers 38, 40 of vessel 36 in the hand-held unit. The vacuum air flow created by vacuum unit 14 is communicated to vacuum chamber 38 through vacuum tube 26, while a heated air flow generated by heating unit 16 travels through heating tube 27 and into heat chamber 40. Outer heat chamber 40 in vessel 36 is separated from inner vacuum chamber 38 by wall 39, which is made of ABS plastic or similar durable and heat resistant material and is approximately 1.5 inches in diameter. Wall 39 is formed with regularly spaced pores 46, each pore being approximately $\frac{1}{8}^{th}$ inch in diameter. The pores 46 are disposed in wall 39 at regularly spaced intervals of approximately 0.5 inch and permit heated air from heat chamber 40 to enter vacuum chamber 38. As shown in FIGS. 3A and 3B, heat chamber 40 is defined by wall 39 and vessel 36 and has a diameter of approximately 3.5 inches, such that vessel 36 is spaced approximately 1 inch away from and outside of wall 39. The end of heat chamber 40 opposite base 30 is sealed to prevent both the loss of heated air and the introduction of hair into the heat chamber.

When both the vacuum and heating units are switched on, the vacuum air flow in vacuum chamber 38 draws heated air in through pores 46, and heated air flows through vacuum chamber 38 in the direction of base 30. Vacuum pressure generated by vacuum unit 14 is of sufficient pressure to hold damp hair taut while in vacuum chamber 38, thereby removing moisture from hair placed in vacuum chamber 38 and at the same time, as dry heated air flows along the length of the hair, accelerating the drying process and creating straight, smooth hair.

Vacuum pressure generated by vacuum unit 14, or heated air flow generated by heating unit 16, may be alternately and temporarily switched off using auxiliary power switches 31 disposed in handle 34 of upper hand-held unit 32. While the device of the present invention may be operated with only one of the vacuum unit 14 and the heating unit 16 switched on, most efficient drying and optimal styling results are achieved when both units are switched on.

Vessel 36 is approximately 12 inches in length and may be adjusted with attachments for drying and straightening longer hair. In addition, various attachments to vessel 36 incorporating hairstyling tools such as combs and rollers can be made available to achieve varied hairstyles using the combined suction and heated air flow of the invention. In an alternative embodiment, wall 39 may be fitted with a retractable comb 35 for combing hair placed in vacuum chamber 38 as the hand-held unit is pulled away from the user's head. It is understood that the design of hand-held unit 32 is not limited to the embodiments shown and described herein, but rather that various embodiments of hand-held unit 32 are available for use in accordance with the grooming device presently described without departing from the scope of the invention.

FIG. 3B is a cross-sectional view of the vessel 36 of the hand-held unit 32 showing in further detail the relative positions of vacuum chamber 38 and heat chamber 40 within vessel 36. As shown in FIG. 3B, vacuum chamber 38 is divided into four equal hair chambers 38*a*, 38*b*, 38*c* and 38*d* by insert 48. Insert 48 may be integrally formed within vessel 36 but is preferably a thin detachable insert made of plastic or other durable material, capable of sliding along the interior of wall 39 and easily removable for cleaning. Use of insert 48 within the hand-held unit of the grooming device prevents tangling of hair placed into vacuum chamber 38.

Figure 4:
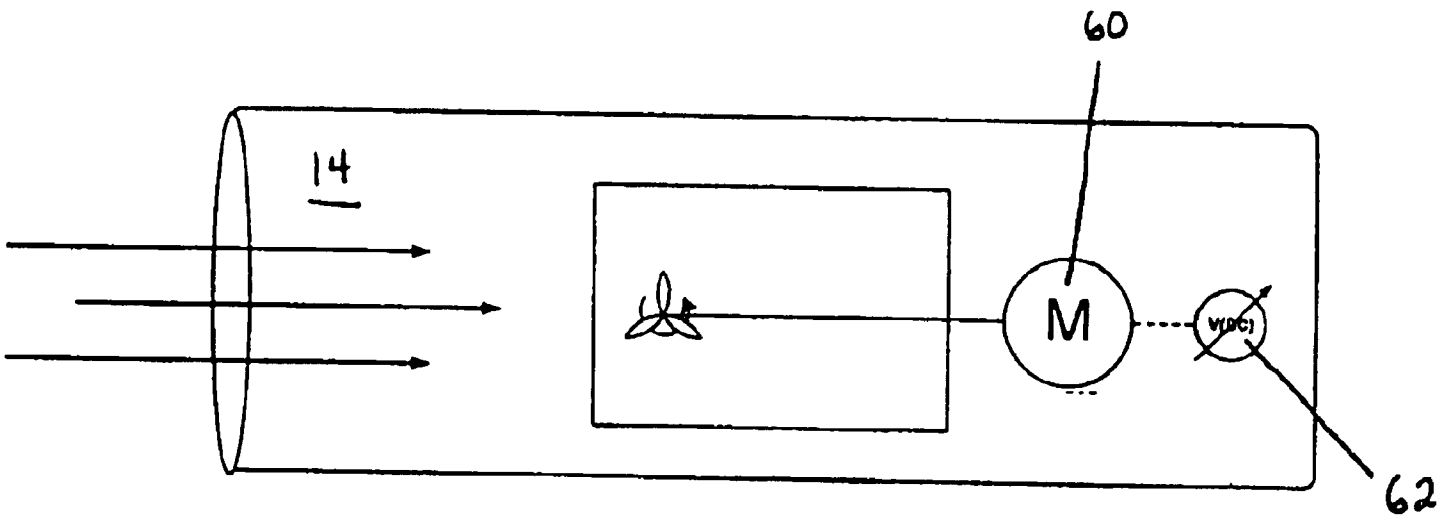
FIG. 4 is a schematic of the vacuum unit in the lower unit of the apparatus of FIG. 1.
Figure 5:
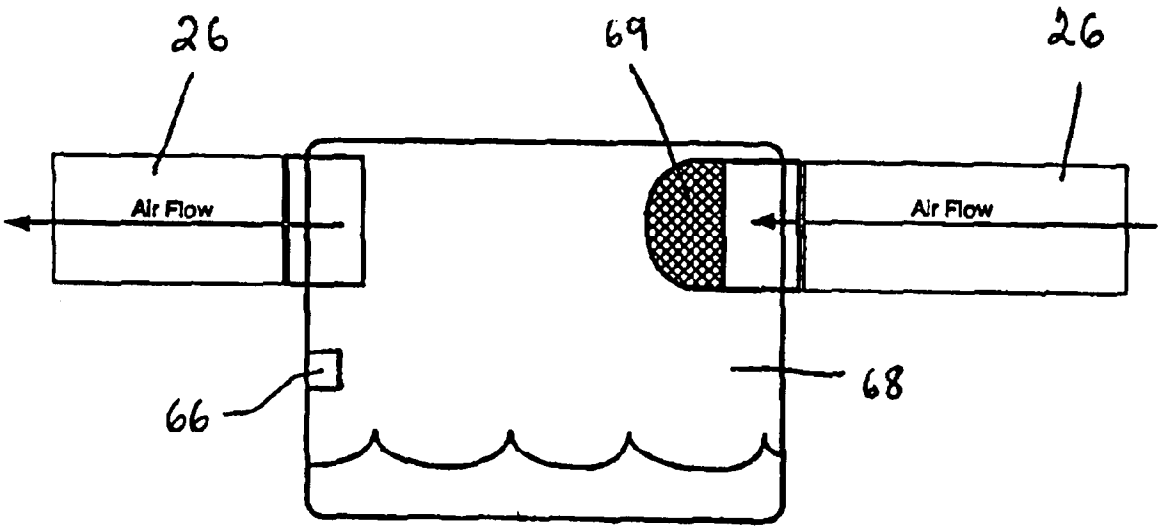
FIG. 5 is a schematic of the water collection chamber in the vacuum unit of the apparatus of FIG. 1.

FIG. 4 is a schematic of the vacuum unit 14 in the apparatus of the present invention. Vacuum unit 14 operates in accordance with household vacuums well known in the art. When vacuum unit 14 is switched on, a small, high-powered universal motor 60 within the unit generates a powerful suction, creating an inward flow of air of approximately 150 cubic feet per minute. The suction is communicated to vacuum chamber 38 through vacuum tube 26 (not shown in FIG. 4). Moisture thereby removed from hair in the vacuum chamber 38 combines with the flow of heated air and travels through vacuum tube 26 as water vapor but, depending on the length and internal temperature of flexible hose 24, it may condense as it approaches vacuum unit 14. A water collection chamber 68, shown in detail in FIG. 5, is therefore provided to divert and collect condensation from the vacuum flow of air. As shown in FIG. 4, vacuum unit 14 may also include an external speed control 62 for varying the input voltage to the motor 60, enabling variation of the vacuum power by, for example, four speed settings, as illustrated by speed control 50 disposed on lower unit 12 in FIG.2.

FIG. 5 is a schematic of water collection chamber 68 that may be removably attached to vacuum unit 14 to divert and collect condensation from the vacuum flow of air. Air in the vacuum flow enters water collection chamber 68 through a sealed inlet from vacuum tube 26, and moisture removed from the air flow collects in the base of chamber 68. Dry air exits the chamber 68 through a sealed outlet and re-enters vacuum tube 26 for re-circulation in the apparatus. The inlet of chamber 68 may further include a removable debris collection filter 69 for removal of dust, hair, lint, and other airborne particles from the vacuum air flow. Water collection chamber 68 may also include a circuit 66 for automatically switching off the vacuum unit 14 when the chamber 68 fills with water to a predetermined level.

Figure 6:
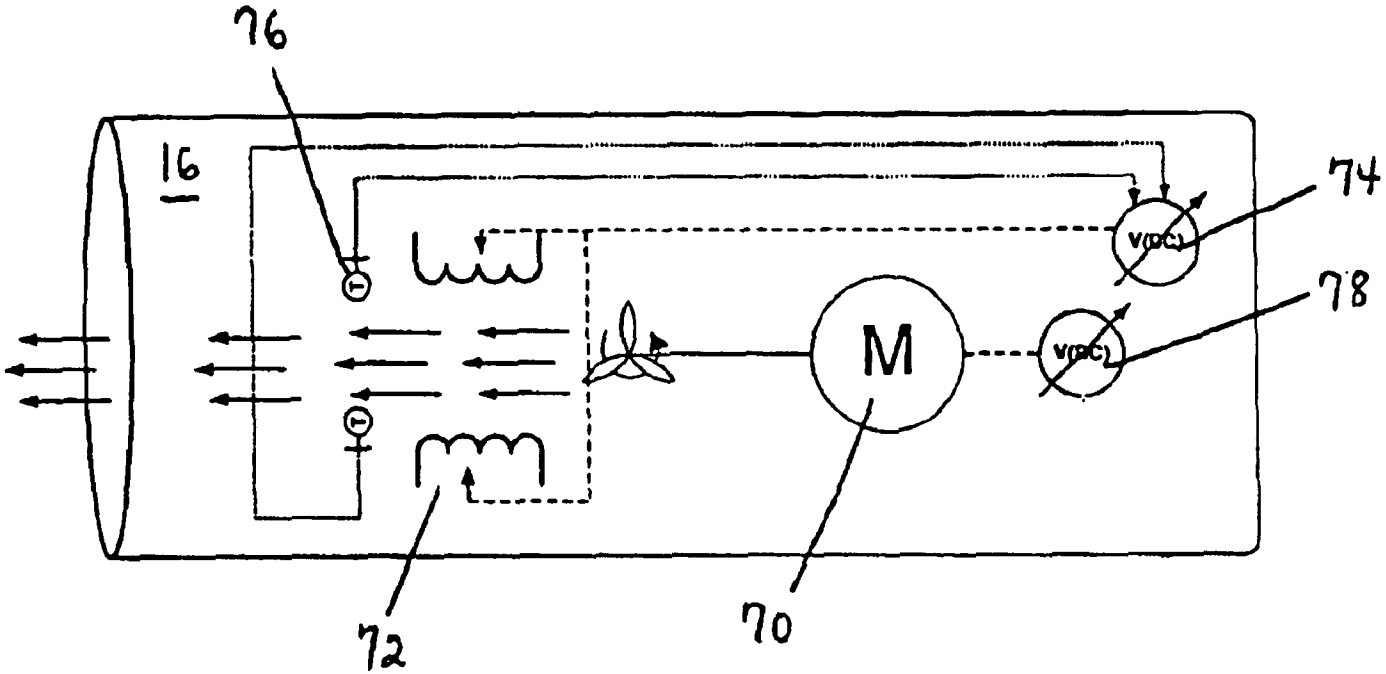
FIG. 6 is a schematic of the heating unit in the lower unit of the apparatus of FIG. 1.

FIG. 6 shows the heating unit 16 in the device of the present invention. As shown in FIG. 6, a series of motors 70 in the heating unit 16 creates an outward flow of air. The air is heated as it flows past heating coils 72. The temperature of the air flow is set by an external heat control 74 having variable hot and cool settings, as illustrated by temperature control 52 disposed on lower unit 12 in FIG. 2. Once the desired temperature is set, temperature sensors in circuit 76 monitor the temperature and adjust current to the heating coils 72 accordingly. Heating unit 16 may also include an external speed control 78 that varies input voltage to motors 70, permitting adjustment of the speed of heated air flow generated by the heating unit 16 through heating tube 27 to heat chamber 40 in the hand-held unit 32.

Figure 7:
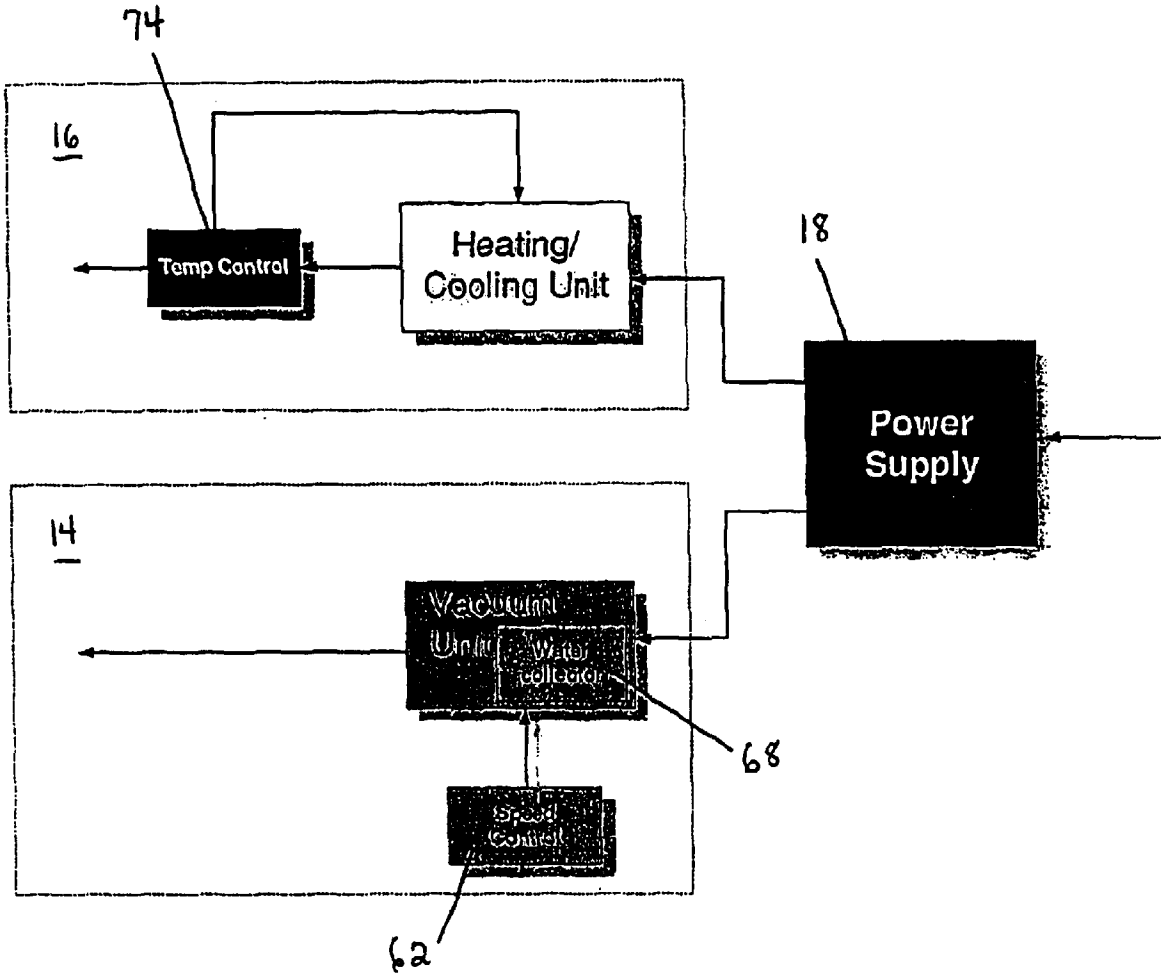
FIG. 7 is a functional block diagram of the lower unit of the apparatus of FIG. 1.

A functional block diagram of the lower unit is shown in FIG. 7. The vacuum unit 14 and heating unit 16 are powered by power supply 18, which is connected to a source of AC current by cord 19 (shown in FIG. 1). In the operation of the invention, vacuum unit 14 and heating unit 16 preferably operate simultaneously within lower unit 12.

Figure 8:
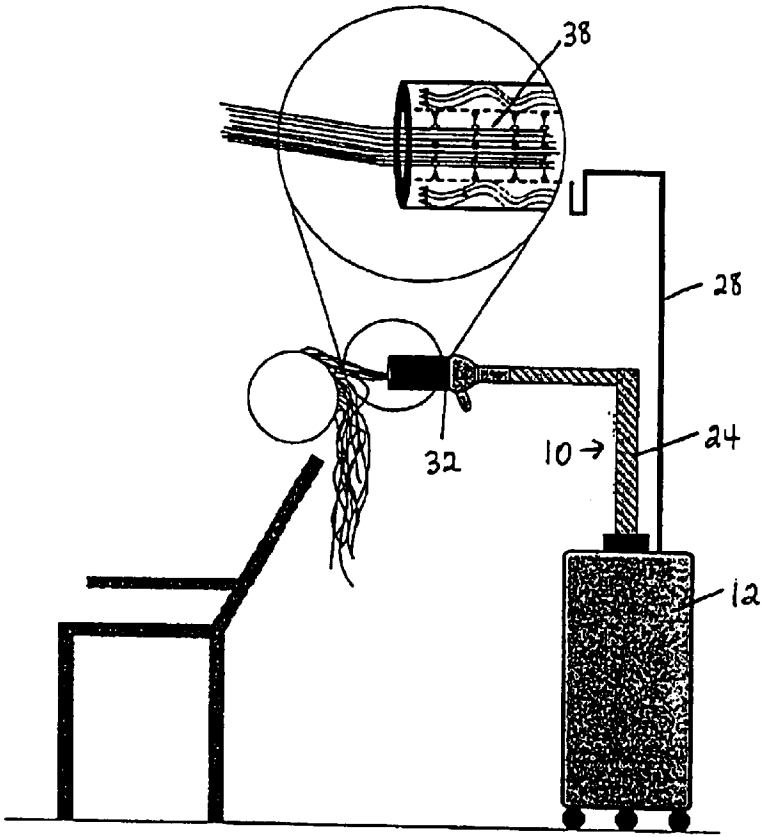
FIG. 8 is an elevational view of the apparatus of FIG. 1 showing the operation of the device in accordance with the present invention.

FIG. 8 shows one embodiment of the grooming device operated in accordance with the present invention. As shown in FIG. 8, hair placed within vacuum chamber 38 of the handheld unit 32 is held taut while simultaneously being dried and straightened at a selected air flow speed and temperature. Regardless of selected temperature and speed settings, the device of the present invention achieves dry, straight, smooth hair in significantly less time, with little or no damage to hair and with much greater ease than conventional hair drying methods.

It is further contemplated that the objects of the present invention may also be achieved by locating the heating unit in the hand-held portion of the grooming device. In a second embodiment of the invention, shown in FIGS. 9A–9C, the hand-held member 100 comprises an inner chamber 101 contained within an inner heating tube 101*a* and an outer chamber or plenum 102 enclosed by a heat-resistant plastic handle 102*a*, as described further below. As shown, the inner heating tube 101*a* has a plurality of venting holes or pores 110 so that ambient air within the plenum 102 may be drawn into the inner chamber 101, particularly when a vacuum air flow is present in the inner chamber 101. A dry, heated vacuum air flow is therefore provided in the inner chamber 101 of the hand-held member.

Figure 9A:
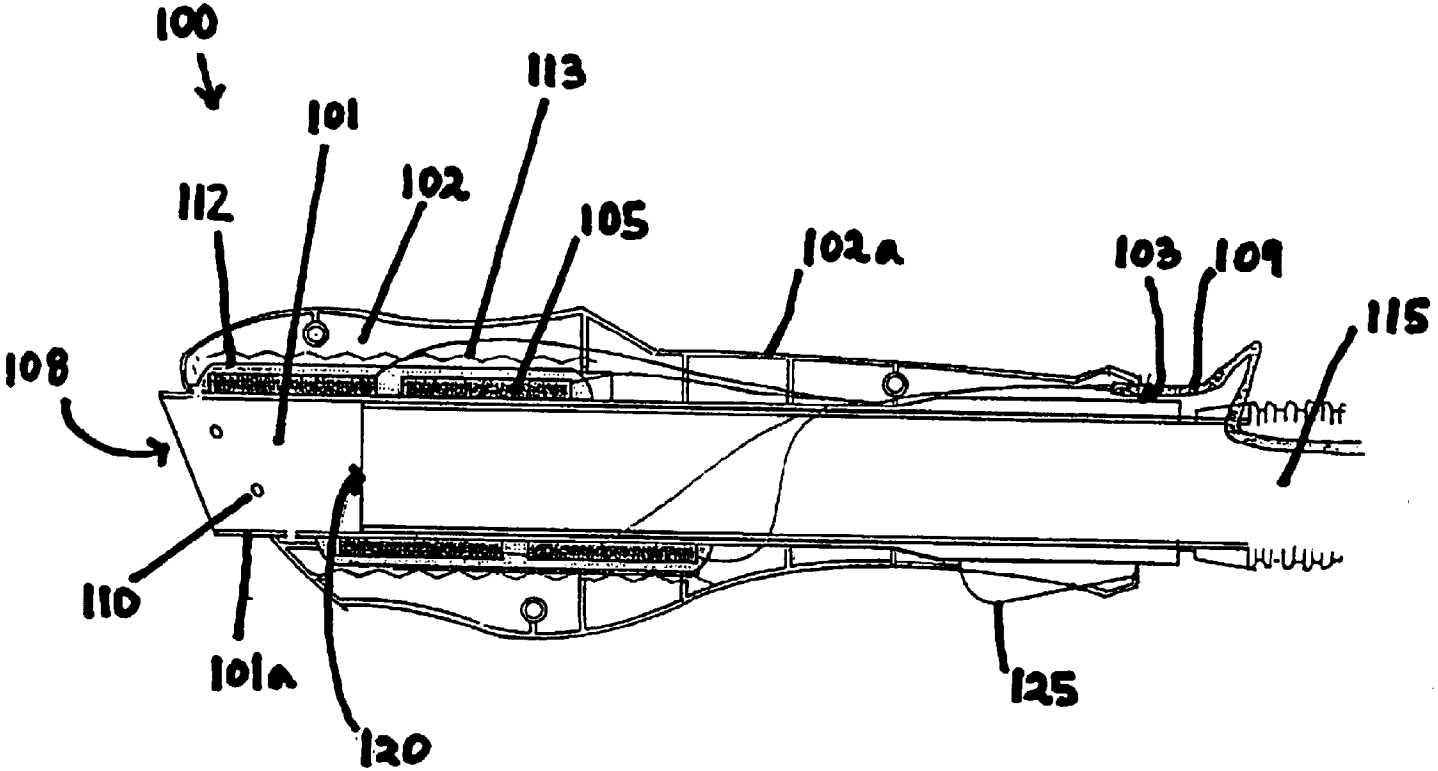
FIG. 9A is a detailed cross-sectional side view of the hand-held unit in a second embodiment in accordance with the present invention.
Figure 9B:
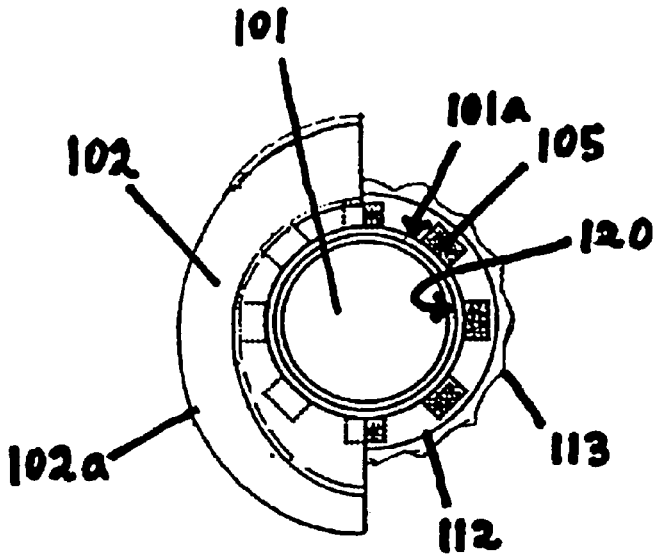
FIG. 9B is a cross-sectional front view of the hand-held unit shown in FIG. 9A.
Figure 9C:
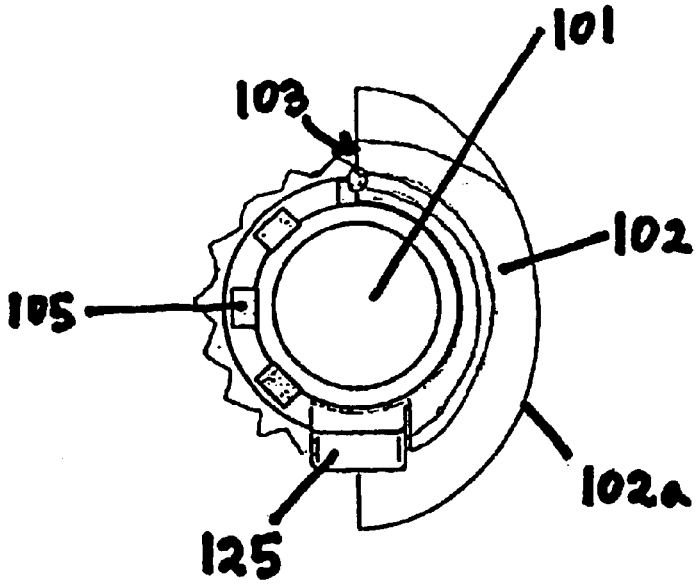
FIG. 9C is a cross-sectional rear view of the hand-held unit shown in FIG. 9A.

More particularly, in the illustrative embodiment, the inner tube 101*a* is made of steel or similar rigid heat conducting material and the outer chamber 102 or plenum is surrounded by a heat-resistant plastic handle 102*a* which may be zinc-coated or aluminized for further heat resistance. As shown in FIG. 9A, the plastic handle 102*a* surrounding the outer chamber 102 can be molded to provide a variety of comfortable grip areas. The handle 102*a* also provides a opening 103 at its rear end, as shown in FIGS. 9A and 9C, which allows outside air to be drawn into the plenum or outer chamber 102.

Heating elements 105 are mounted on the outer wall of the inner tube 101*a* of the hand held device, such that heat generated by the elements 105 is radiated into the inner chamber 101. The heating elements 105 are uniformly spaced around the circumference of the inner tube 101*a*, as shown in FIGS. 9B and 9C, and are concentrated toward the front end or tip 108 of the hand-held member 100. In addition, the tip 108 of the member 100 may be contoured as shown, so that when wet hair is placed in the inner chamber 101, heat is applied closer to the user's head and scalp, resulting in comfortable and rapid drying and grooming time. The heating elements 105 are connected to a power source by wire coils 109, which may be glass-wrapped for heat shielding. In the illustrative embodiment, inner and outer heat shields 112, 113 are positioned around the heating elements 105 to prevent overheating at the handle area.

When the vacuum unit, located in a base unit (not shown in FIGS. 9A–9C), is activated, a vacuum air flow is created in the inner chamber 101. As shown in FIG. 9B, air may enter the inner chamber 101 from the outside, but the rest of the tip 108 of the hand-held member is sealed. When the vacuum unit is activated, ambient air from within the plenum 102 is drawn through holes 110 disposed near the tip 108 of the tube 101*a* into the inner chamber 111, where it is combined with the vacuum air flow entering inner chamber 101 and heated by radiating heat from heating elements 105.

The hand-held member 100 is attached to the rest of the grooming device by a flexible corrugated hose 115. The hose 115 also contains the wire coils 109 which provide power to the heating elements 105.

The illustrative embodiment further comprises a telescoping inner tube 120 disposed within the inner chamber 101 that may be extended from the rear of the hand-held member 100 to accommodate longer hair. A telescoping tube release mechanism 125 is provided to extend the tube and to lock the tube 120 in place within the inner tube 101 when not in use.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. A grooming device comprising:

a first elongated chamber having an opening transverse to the length of the first elongated chamber for entry of hair into the first elongated chamber;

a vacuum unit for generating a vacuum air flow in said first elongated chamber; and an assembly adapted to cause said vacuum air flow to be heated;

whereby said vacuum air flow causes hair adjacent said opening to enter said first elongated chamber in the direction of the length of said first elongated chamber and to be drawn into said first elongated chamber along said length and said vacuum air flow when heated causing heated air flow to be applied to said hair.

2. The grooming device of claim 1, wherein said assembly comprises a heating unit for generating a heated air flow to a second chamber communicating with the first elongated chamber, and wherein said vacuum air flow and said heated air flow are combined in said first elongated chamber so as to be able to be applied simultaneously to hair placed in said first elongated chamber.

3. The grooming device according to claim 2, wherein said first elongated chamber and said second chamber are separated by a wall adapted to allow airflow therethrough and said heated air flow enters said first elongated chamber through said wall.

4. The grooming device according to claim 3, wherein pores are disposed in said wall.

5. The grooming device according to claim 2, wherein the vacuum pressure of said combined vacuum air flow and heated air flow is sufficient to hold hair placed in said first elongated chamber taut.

6. The grooming device according to claim 5, wherein said first elongated chamber and said second chamber are disposed in a hand-held unit and said vacuum unit and heating unit are disposed in a base unit.

7. The grooming device according to claim 6, wherein said hand-held unit is connected to said base unit by a hose.

8. The grooming device according to claim 7, wherein said hose is flexible and contains a heating tube communicating with said second chamber and a vacuum tube communicating with said first elongated chamber.

9. A grooming device comprising:

a first unit containing a vacuum unit connected to a vacuum tube and a heating unit connected to a heating tube; and a second unit connected to said first unit by a hose, said hose containing said vacuum and heating tubes, said second unit comprising a base and a vessel, said vessel comprising an elongated inner vacuum chamber having an opening transverse to the length of the elongated inner vacuum chamber for entry of hair into said chamber, and an outer heat chamber communicating with said elongated inner vacuum chamber through a wall, said base enclosing sealed junctions of said vacuum tube with said vacuum chamber and of said heating tube with said heat chamber;

wherein said elongated inner vacuum chamber is heated by said heating unit, and wherein said vacuum unit creates a vacuum air flow within said elongated inner vacuum chamber of said vessel, causing hair adjacent said opening to enter said elongated inner vacuum chamber in the direction of the length of the chamber and to be drawn into said chamber along said length, and said vacuum air flow when heated causing said hair to be heated.

10. The grooming device according to claim 9, wherein pores are disposed in said wall of said vessel.

11. The grooming device according to claim 10, wherein said outer heat chamber of said vessel is sealed at an end of said chamber opposite the base of the second unit.

12. The grooming device according to claim 11, wherein said elongated inner vacuum chamber is divided into equal-sized chambers by a removable insert.

13. The grooming device according to claim 11, wherein said wall further comprises a retractable hair styling tool.

14. The grooming device according to claim 13, wherein said hair styling tool is a comb.

15. The grooming device according to claim 9, further including an attachment to said second unit, said attachment comprising a housing including an inner vacuum enclosure and outer heat enclosure separated from said inner vacuum enclosure by a wall member, said wall member having through opening, said inner vacuum enclosure and outer heat enclosure of said attachment corresponding to, and capable of forming an airtight connection with, the inner vacuum chamber and outer heat chamber of the vessel in the second unit.

16. The grooming device according to claim 10, wherein said pores have a diameter of between approximately 0.125 inch and 0.25 inch and are spaced approximately 0.5 inches apart.

17. The grooming device according to claim 9, wherein a handle is formed in said base of said second unit.

18. The grooming device according to claim 17, wherein said base and handle are formed from plastic.

19. The grooming device according to claim 9, wherein said vessel and wall are each enclosed by heat-resistant material.

20. The grooming device according to claim 9 wherein said hose is attached to said second unit at said base of the second unit and is attached to said first unit.

21. The grooming device according to claim 20, wherein said hose is flexible.

22. The grooming device according to claim 9, wherein said vacuum unit in said first unit comprises a high-powered universal motor for generating a vacuum flow of air.

23. The grooming device according to claim 22, wherein the operation of said vacuum unit is controlled by an external power switch.

24. The grooming device according to claim 23, wherein said vacuum unit further includes a water collection chamber in which condensation in said inward flow of air is collected.

25. The grooming device according to claim 24, wherein said water collection chamber further comprises a circuit for cutting off power to said vacuum unit when a predetermined level of water is collected in said water collection chamber.

26. The grooming device according to claim 23, wherein said external switch controls the speed of vacuum air flow generated by said vacuum unit.

27. The grooming device according to claim 9, wherein said heating unit in said first unit comprises a series of motors for generating a flow of heated air from said heating unit, through the heating tube in the hose and into said heat chamber in said second unit.

28. The grooming device according to claim 27, wherein said heating unit further includes at least one heating coil for heating said flow of air and a circuit for monitoring and controlling the temperature of said at least one coil.

29. The grooming device according to claim 28, said first unit further comprising an external switch for controlling the temperature of said at least one heating coil monitored and controlled by said circuit in the heating unit.

30. The grooming device according to claim 29, further comprising a second external switch for controlling the speed of heated air flow generated by said heating unit.

31. The grooming device of claim 1, wherein said assembly includes a heating element for heating said first elongated chamber.

32. The grooming device of claim 31, wherein said heating element is mounted on the wall of said first elongated chamber toward the end of said first elongated chamber receiving said hair, said wall of said first elongated chamber being heat conductive, and said heating element heating said wall and said heated wall causing heating of said vacuum air flow.

33. The grooming device of claim 32, wherein said assembly includes a second chamber surrounding said first elongated chamber.

34. The grooming device of claim 33, wherein the wall of said first elongated chamber has at least one opening therethrough for air to pass from said second chamber to said first elongated chamber.

35. The grooming device of claim 34, wherein said heating element borders said at least one opening in said wall of said first elongated chamber.

36. The grooming device of claim 35, wherein said wall of said second chamber has an opening permitting outside air to enter said second chamber.

37. The grooming device of claim 36, wherein said opening in said wall of said second chamber is at the end opposite the end adjacent where hair is received in said first elongated chamber.

38. The grooming device of claim 37, wherein said heating element comprises a plurality of heating segments distributed about the circumference of the wail of said first elongated chamber.

39. The grooming device of claim 38 wherein said heating element is surrounded by a thermally insulating material.

40. The grooming device of claim 33, wherein the wall of said second chamber comprises a thermally insulating material.

41. The grooming device of claim 31, wherein said first elongated chamber is surrounded by a thermally insulating material.

42. A grooming device according to claim 1, wherein:

said assembly causes said vacuum air flow to be heated as the vacuum air flow travels within said first elongated chamber, whereby said vacuum air flow as said vacuum air flow is heated within said first elongated chamber causing heated air flow to be applied to said hair within said first elongated chamber.

* * * * *